US007633459B2

(12) United States Patent
Christie et al.

(10) Patent No.: US 7,633,459 B2
(45) Date of Patent: Dec. 15, 2009

(54) ANTENNA AND AN ANTENNA FEED STRUCTURE

(75) Inventors: Andrew Robert Christie, Mawsley (GB); Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 0 days.

(21) Appl. No.: 11/899,413

(22) Filed: Sep. 4, 2007

(65) Prior Publication Data

US 2008/0062064 A1 Mar. 13, 2008

Related U.S. Application Data

(63) Continuation-in-part of application No. 11/472,587, filed on Jun. 21, 2006, now Pat. No. 7,439,934.

(60) Provisional application No. 60/849,360, filed on Oct. 3, 2006.

(30) Foreign Application Priority Data

Sep. 6, 2006 (GB) ..... 0617571.5

(51) Int. Cl.
*H01Q 1/36* (2006.01)

(52) U.S. Cl. ..... 343/895; 343/860; 343/850

(58) Field of Classification Search ..... 343/895, 343/850, 859, 860
See application file for complete search history.

(56) References Cited

U.S. PATENT DOCUMENTS 3,599,220 A 8/1971 Dempsey
4,008,479 A 2/1977 Smith
4,554,554 A 11/1985 Olesen et al.
4,608,574 A 8/1986 Webster et al.
5,191,352 A 3/1993 Branson
5,346,300 A 9/1994 Yamamoto et al.
5,349,365 A 9/1994 Ow et al.
5,635,945 A 6/1997 McConnell et al.
5,838,282 A 11/1998 Lalezari et al.
5,854,609 A 12/1998 Pyo et al.
5,945,963 A 8/1999 Leisten
5,963,180 A 10/1999 Leisten (Continued)

FOREIGN PATENT DOCUMENTS

CN 2899134 Y 5/2007

(Continued)

*Primary Examiner*—Trinh V Dinh
*Assistant Examiner*—Dieu Hien T Duong
(74) *Attorney, Agent, or Firm*—John Bruckner PC

(57) ABSTRACT

A dielectrically-loaded helical antenna has a ceramic cylindrical core and, formed on the cylindrical surface of the core, a plurality of conductive helical antenna elements. The antenna elements are coupled to a pair of feed connection conductors generally centrally located on an end surface of the core, the coupling between the antenna elements and the feed connection conductors being by way of a matching section comprising a laminate board having at least three conductive layers and insulative layers between the conductive layers arranged in an alternating manner. Each conductive layer has a first portion forming part of a respective shunt capacitance, the conductive layers and the insulative layers together acting to form a plurality of capacitors shunt-connected across the antenna elements. One of the conductive layers includes a second portion forming a series inductance between one of the feed connection conductors and at least one of the antenna elements.

21 Claims, 7 Drawing Sheets

U.S. PATENT DOCUMENTS

| | | | | |
|---|---|---|---|---|
| 6,011,524 | A | 1/2000 | Jervis | |
| 6,031,495 | A | 2/2000 | Simmons et al. | |
| 6,094,178 | A | 7/2000 | Sanford | |
| 6,133,891 | A | 10/2000 | Josypenko | |
| 6,150,984 | A | 11/2000 | Suguro et al. | |
| 6,229,488 | B1 | 5/2001 | Lin et al. | |
| 6,229,499 | B1 | 5/2001 | Licul et al. | |
| 6,232,929 | B1 | 5/2001 | Ermutlu et al. | |
| 6,300,917 | B1 | 10/2001 | Leisten et al. | |
| 6,369,776 | B1 | 4/2002 | Leisten et al. | |
| 6,384,798 | B1 | 5/2002 | Barta et al. | |
| 6,476,776 | B1 | 11/2002 | Kurby | |
| 6,480,173 | B1 | 11/2002 | Marino | |
| 6,552,693 | B1 | 4/2003 | Leisten | |
| 6,690,336 | B1 | 2/2004 | Leisten et al. | |
| 6,765,541 | B1 | 7/2004 | Josypenko | |
| 6,821,859 | B2 | 11/2004 | Raebiger et al. | |
| 6,886,237 | B2 | 5/2005 | Leisten et al. | |
| 6,914,580 | B2 | 7/2005 | Leisten | |
| 7,256,752 | B2 * | 8/2007 | Wither et al. | 343/905 |
| 2002/0113731 | A1 | 8/2002 | Strickland | |
| 2006/0067419 | A1 | 3/2006 | Sandhu | |
| 2006/0082517 | A1 * | 4/2006 | Chung et al. | 343/895 |

FOREIGN PATENT DOCUMENTS

| | | | |
|---|---|---|---|
| EP | 0469741 | | 2/1992 |
| EP | 0528175 | A | 2/1993 |
| EP | 1076378 | | 2/2001 |
| EP | 1306921 | A | 5/2003 |
| GB | 587627 | A | 5/1947 |
| GB | 2202638 | | 9/1988 |
| GB | 2282487 | A | 4/1995 |
| GB | 2292257 | | 2/1996 |
| GB | 2292638 | A | 2/1996 |
| GB | 2310543 | A | 8/1997 |
| GB | 2311675 | | 10/1997 |
| GB | 2338605 | A | 12/1999 |
| GB | 2351850 | A | 1/2001 |
| GB | 2367429 | A | 4/2002 |
| GB | 2419037 | A | 4/2006 |
| GB | 2424521 | | 9/2006 |
| JP | 02278901 | | 11/1990 |
| JP | 2004040596 | | 2/2004 |
| TW | 1238566 | | 7/1993 |
| TW | M276332 | | 2/2005 |
| TW | 1248230 | | 1/2006 |
| WO | WO 99/26316 | | 5/1999 |
| WO | WO 99/31820 | | 6/1999 |
| WO | WO0048268 | | 8/2000 |
| WO | WO03044895 | | 5/2003 |
| WO | WO2006136809 | | 12/2006 |
| WO | WO2006136810 | | 12/2006 |

* cited by examiner

ANTENNA AND AN ANTENNA FEED STRUCTURE

CROSS-REFERENCES TO RELATED APPLICATIONS

This application claims a benefit of priority under 35 U.S.C. 119(e) from provisional patent application U.S. Ser. No. 60/849,360, filed Oct. 3, 2006, the entire contents of which are hereby expressly incorporated herein by reference for all purposes. This application is related to, and claims a benefit of priority under one or more of 35 U.S.C. 119(a)-119(d) from copending foreign patent application 0617571.5, filed in the United Kingdom on Sept. 6, 2006 under the Paris Convention, the entire contents of which are hereby expressly incorporated herein by reference for all purposes. This application is a continuation-in-part of, and claims a benefit of priority under 35 U.S.C. 120 from utility patent application U.S. Ser. No. 11/472,587, filed Jun. 21, 2006 now U.S. Pat. 7,439,934.

BACKGROUND INFORMATION

1. Field of the Invention

This invention relates to a dielectrically-loaded antenna and to a feed structure for such an antenna.

2. Discussion of the Related Art

British Patent Applications Nos. 2292638A and 2310543A disclose dielectrically-loaded antennas for operation at frequencies in excess of 200 MHz. Each antenna has two pairs of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feed structure comprising an inner conductor surrounded by a shielded conductor. At one end of the core the feed structure conductors are connected to respective antenna elements which have associated connection portions adjacent the end of the bore. At the other end of the bore, the shield conductor is connected to a conductor which links the antenna elements and, in these examples, is in the form of a conductive sleeve encircling part of the core to form a balun. Each of the antenna elements terminates on a rim of the sleeve and each follows a respective helical path from its connection to the feed structure.

British Patent Application No. 2367429A discloses such an antenna in which the shield conductor is spaced from the wall of the bore, preferably by a tube of plastics material having a relative dielectric constant which is less than half of the relative dielectric constant of the solid material of the core.

Dielectrically-loaded loop antennas having a similar feed structure and balun arrangement are disclosed in GB2309592A, GB2338605A, GB2351850A and GB2346014A. Each of these antennas has the common characteristic of metallised conductor elements which are disposed about the core and which are top-fed from a feed structure passing through the core. The conductor elements define an interior volume occupied by the core and all surfaces of the core have metallised conductor elements. The balun provides common-mode isolation of the antenna elements from apparatus connected to the feeder structure, making the antenna especially suitable for small handheld devices.

The feed structure is formed in the above-noted antennas as follows. Firstly, a flanged connection bush, plated on its outer surface, is fitted to the core by being placed in the end of the bore where the feed connection is to be made. Then, an elongate tubular spacer is inserted into the bore from the other, bottom, end. Next, a coaxial line of predetermined characteristic impedance is trimmed to length and an exposed part of the inner conductor at one end is bent over into a U-shape. The formed section of coaxial cable is inserted into the bore and the elongate tubular spacer from above and the entire top connection is soldered in two soldering steps: (a) soldering of the inner conductor bent portion to connection portions of the antenna elements on the top face of the core, and (b) soldering of the flanged bush to the shield conductor and to further antenna element connection portions on the top face of the core. The core is then inverted and a second plated bush is fitted over the outer shield conductor of the cable where it is exposed at the opposite end of the core from the bent section of the inner conductor so as to abut the plated bottom end face of the core. Finally, this second bush is soldered to the outer shield conductor and to the plated bottom end face of the core.

One of the objectives in the design of the antennas disclosed in the prior applications is to achieve as near as possible a balanced source or load for the antenna elements. Although the balun sleeve generally serves to achieve such balance, some reactive imbalance may occur owing to constraints on the characteristic impedance of the coaxial feeder structure and on its length. Additional contributing factors are the difference in length between the inner and outer conductors of the feed structure, e.g., as a result of the bent-over part of the inner conductor, and the inherent asymmetry of a coaxial feed. Where necessary, a compensating reactive matching network in the form of a shorted stub has been connected to the inner conductor adjacent the bottom end face of the core, either as part of the device to which the antenna is connected or as a small shielded printed circuit board assembly attached to the bottom end face of the core.

The applicant's co-pending International Patent Application No. PCT/GB2006/002255 discloses an antenna feed structure and a method of assembling a dielectrically-loaded helical antenna. The feed structure comprises the combination of a length of coaxial transmission line and a laminate board extending laterally of the axis defined by the coaxial line. The board is secured to the distal end of the coaxial transmission line by a plurality of lugs, formed integrally with the coaxial outer conductor at its upper edge, the lugs passing through holes in the laminate board. During assembly of the antenna, the feed structure combination is inserted into the distal end of the antenna core. The board comprises two circular insulative layers and two conductive layers. One of the conductive layers is formed on a proximal surface of a proximal insulative layer, and the other conductive layer is sandwiched between the two insulative layers. When in position, the layers of the laminate board are arranged such that a shunt capacitance is formed across the inner and outer conductors of the coaxial transmission line and across at least one pair of helical antenna elements. The combination of the length of coaxial transmission line and the laminate board constitute a unitary feed structure which can be assembled prior to insertion into the antenna. In this way, the laminate board provides a matching structure between the antenna elements and the transmission line.

The shunt capacitance of the above-described laminate board structure is limited by the area of the layers, the depth of the insulative layers and the dielectric constant $\in_r$ of the proximal insulative layer. In practice, this means that there is a lower limit to the frequency at which the laminate board can act as an effective matching structure. In particular, it has been noted by the applicant that although the design is suitable for a satellite radio operating around 2.3 GHz, the design cannot provide high enough capacitance to be effective for GPS L1-band signals at around 1.5 GHz.

SUMMARY OF THE INVENTION

It is an object of the present invention to provide a matching structure with increased capacitance, and therefore an antenna for use at lower frequencies.

According to one aspect, the invention provides a dielectrically loaded antenna for operation at a frequency in excess of 200 MHz comprising: an electrically insulative core of a solid material having a relative dielectric constant greater than 5 and having transversely extending end surfaces and a side surface which extends longitudinally between the end surfaces; a three-dimensional antenna element structure including at least a pair of elongate conductive antenna elements disposed on or adjacent the side surface of the core and extending from one of the end surfaces towards the other end surface; a feed connection comprising first and second feed connection conductors coupled respectively to one and the other of the elements of the said pair; and a matching section comprising a laminate board having at least two insulative layers and at least three conductive layers, arranged alternately, wherein each conductive layer comprises a first portion, each first portion being a conductor of a shunt capacitance, formed by said layers and coupled across the antenna elements of the pair.

The laminate board and feed connection together form a feed structure which may also include a length of transmission line that passes longitudinally through the core on an axis of the antenna. The antenna elements extend from the feed connection at one end of the feed structure to the proximal end of the insulative core and may be connected together by a common conductor, such as a sleeve, which is also connected to the feed structure at the proximal end of the core so as to act as a balun. The sleeve can act in combination with a shield conductor of the feed structure to provide a balanced source or load for the antenna elements at the feed connection, the antenna as a whole presenting a single-ended 50 ohm termination for equipment to which it is to be connected. In such a structure, the antenna element structure has metallised conductor elements.

The layers of the laminate board provide matching of the antenna to the equipment to which it is connected. The laminate board is preferably located on a distal end of the core and forms a connection between the transmission line and the antenna elements. The transmission line is preferably a coaxial transmission line and the board may be axially connected to one end of the coaxial transmission line, which may extend perpendicularly from the laminate board. In this manner, conductive layer portions on the underside of the board make face-to-face contact with tracks printed on the core.

The laminate board comprises at least two insulative layers and at least three conductive layers. The conductive layers may be coupled directly to the inner and outer conductors of the coaxial transmission line and the antenna elements of the antenna element structure and are arranged so as to provide at least two effective shunt capacitors between the inner and outer conductors. The first and second conductive layers act as the plates of a first capacitor and the second and third layers act as the plates of a second capacitor. By providing the layers in this manner the overall capacitance can be increased when compared with a two conductive layer capacitor of similar dimensions.

The preferred feed structure comprises the combination of a length of coaxial transmission line and the laminate board. The inner conductor of the line may be located in a through-hole in the board to connect to a track on one face of the board, while the shield connects to the underside of the board or directly to a conductor on the upper or distal face of the core. The characteristic impedance of the transmission line is typically 50 ohms.

Depending on the length and characteristic impedance of the coaxial line, the reactance compensation performed by the matching network may include an inductive component. In particular, the matching network may also include an inductance embodied as a conductive track on the board.

In the disclosed antenna, the matching network comprises a shunt capacitance constituted by two shunt capacitors embodied as conductive layer portions in registry with each other as described above. The inductance may be incorporated, e.g., as a series element in the form of a length of conductive track on the board between a connection to the inner conductor of the coaxial line and a connection to a conductor on the distal face of the core. In this way, the matching network can effect a transformation from the source or load impedance represented by the antenna, which is typically less than 5 ohms and may be as low as 2 ohms, to the load or source impedance presented at the distal end of the coaxial line when the antenna is connected to the radio frequency equipment with which it is to be used, typically having a 50 ohm termination.

The combination of the laminate board and the coaxial line may constitute a unitary feed structure which, during manufacture of the antenna, is slidably inserted as a unit into the passage through the antenna core, the feed structure being inserted from the distal face of the core. Abutment of the board and the distal face of the core may be used to locate the feed structure in the axial direction. Solder paste is screen-printed to form a connection between the board and the core and, around the coaxial line where it is exposed at the proximal face of the core a solder perform is used to allow a one-shot reflow soldering of the feed structure components to metallised conductor elements on all surfaces of the core.

Mechanical connection between the laminate board and the coaxial line may be made to way of one or more longitudinally extending lugs on the shield conductor of the coaxial line located in correspondingly formed recesses or holes in the board where the lugs may be soldered to conductive layer portions on the board. The lugs may be an interference fit in the holes or recesses, or they may be bent over to lock the board to the shield. As an alternative, the distal end of the shield may be swaged outwardly to locate against a distally facing surface on the core adjacent the distal end of the passage and to provide for abutting electrical connection to a conductive layer portion on the proximal surface of the board.

The preferred antenna is a quadrifilar helical antenna having four longitudinally coextensive half-turn helical antenna elements which, at the distal end of the core, have distal ends spaced around the periphery of the top face of the core. In the preferred embodiment, four respective radial tracks are plated on the distal face of the core, these being connected together in pairs. Advantageously, the conductive layers of the laminate board which interconnect the transmission line conductors to the radial tracks, whether via plated edges of the board or by means of vias through the board, define connections with the radial tracks which, together, subtend an angle of at least 45° at the core axis. Typically, the subtended angle is in the region of 90°. To achieve a smooth transition of current flow, these conductive layers are preferably fan-shaped (sector-shaped in the most preferred embodiment).

It will be understood that, in a preferred method of assembling the antenna, the feed structure is presented as a unit to the core and inserted into the passage in the core, the insertion causing connection members on the board that extend laterally of the axis of the coaxial line to engage conductive portions on the core, whereafter the laterally extending connection members are conductively bonded to the or each engaged conductive portion on the core. Preferably, the conductive bonding is performed as a single soldering operation. The method includes the further step of conductively bonding the shield conductor to a grounding face of the core, preferably as part of the single soldering operation. In the alternative, the coaxial line is first inserted into the core to a predetermined position and, next, the printed circuit board is placed over the distal end of the core and the distal end of the coaxial line. Then, conductive bonding between the coaxial line and the core and/or the coaxial line and the board, as well as between the board and the core, may be performed in a single operation.

The feed structure may include means for spacing an outer wall of the shield conductor from the wall of the passage.

The inner conductor and the shield conductor may be insulated from each other by an air gap over the major part of their length.

According to a further aspect of the invention, there is provides a dielectrically loaded antenna for operation at frequencies in excess of 200 MHz comprising: an electrically insulative core of a solid material having a relative dielectric constant greater than 5 and having transversely extending end surfaces and a side surface which extends longitudinally between the end surfaces; a three dimensional antenna element structure including at least a pair of elongate conductive antenna elements disposed on or adjacent the side surface; a feed connection comprising first and second feed connection conductors coupled respectively to one and the other of the said pair of antenna elements; and a matching section comprising at least two effective shunt capacitors.

According to yet a further aspect of the invention, there is provided a unitary antenna feed structure for sliding installation in a passage in the insulative core of a dielectrically loaded antenna, wherein the feed structure comprises the unitary combination of: a tubular outer shield conductor; an elongate inner conductor extending through the shield conductor and insulated from the shield conductor; and a laminate board extending laterally outwardly from a distal end of the shield conductor, the laminate board comprising: a proximal surface having first and second proximally directed conductive portions for connection to respective first and second conductors on the antenna core adjacent an end of the passage, the first proximally directed conductive portion and the outer shield conductor being electrically connected; and a distal surface having first and second distally directed conductive portions for connection to respective first and second conductors on the antenna core, the first distally directed conductive portion and the outer shield conductor being electrically connected; and an intermediate layer of conductive material having a first conductive portion for connection to second conductors on the antenna core and electrically connected to the inner conductor; wherein each of said first portions are conductors of a shunt capacitance formed by said laminate board.

BRIEF DESCRIPTION OF THE DRAWINGS

The invention will now be described by way of example with reference to the drawings in which:—

DESCRIPTION OF PREFERRED EMBODIMENTS

Figure 1:
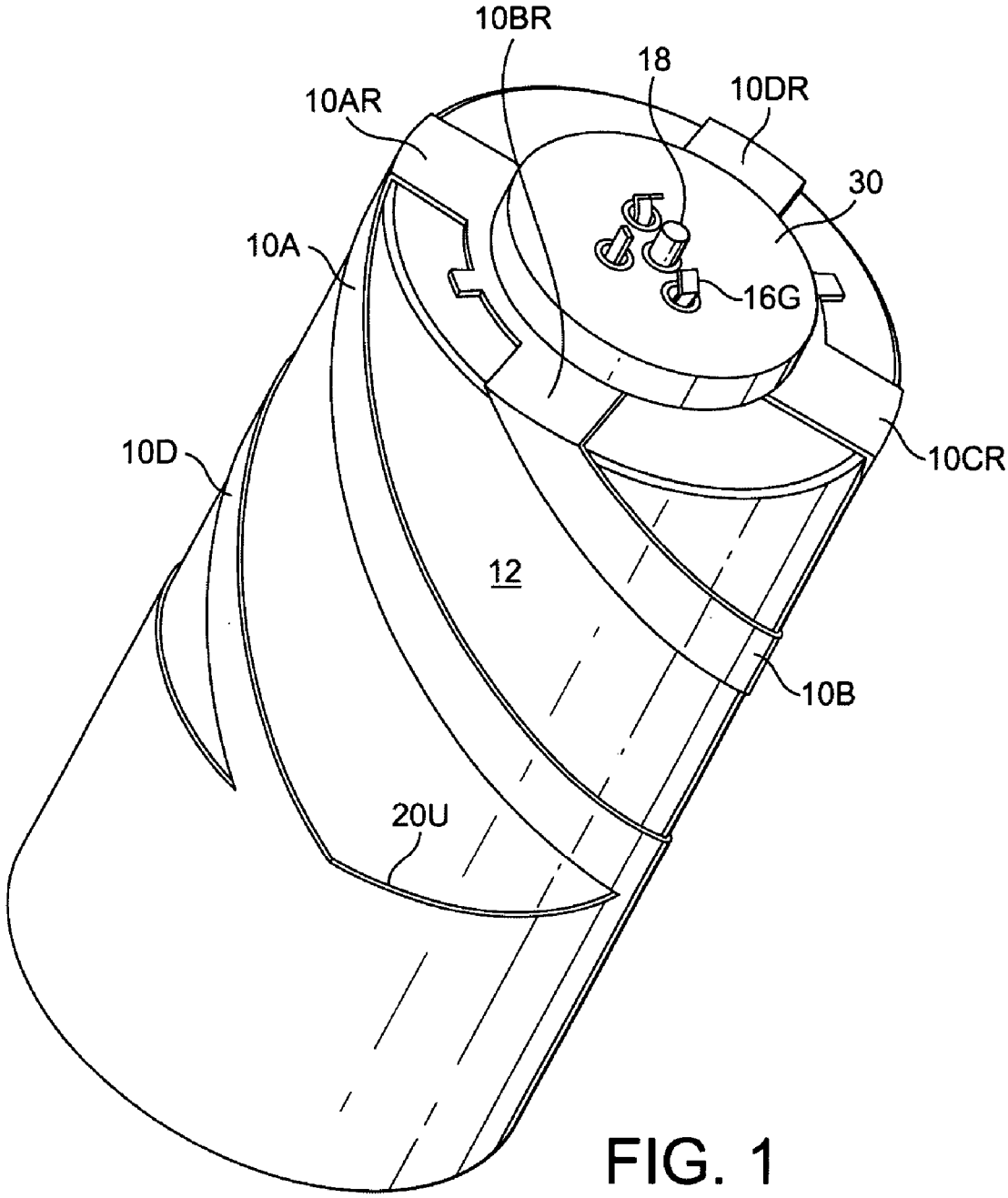
FIG. 1 is a perspective view of a first quadrifilar helical antenna in accordance with the invention, viewed from the above and the side.
Figure 2:
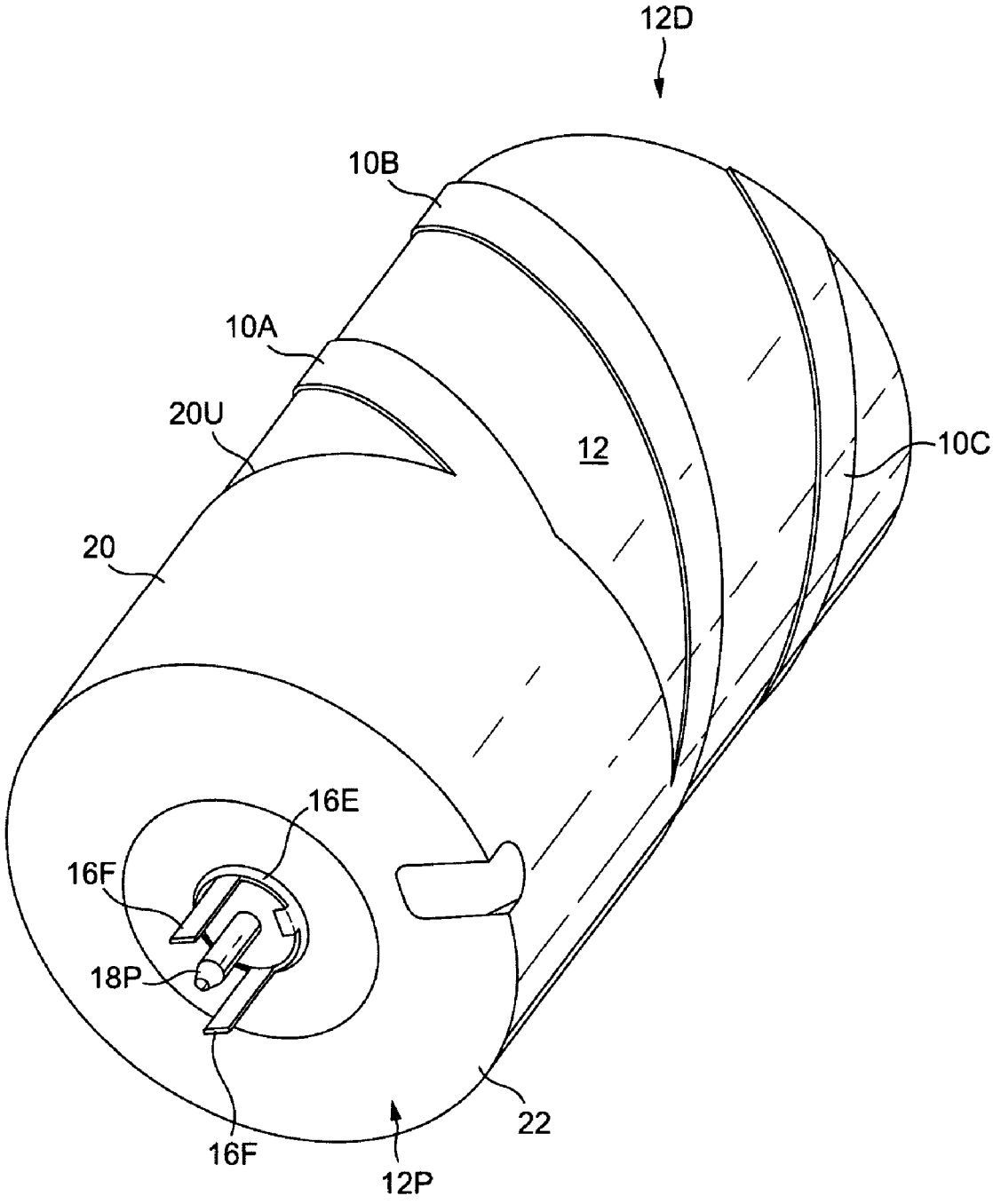
FIG. 2 is a perspective view of the first antenna from below and the side.
Figure 3:
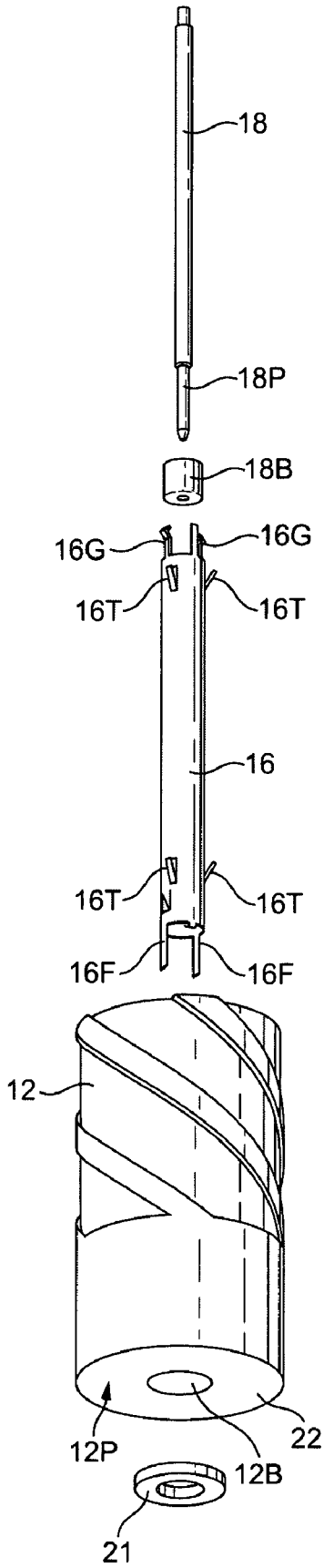
FIG. 3 is a exploded perspective view of a plated antenna core and a coaxial feeder of the antenna of FIGS. 1 and 2.

The entire contents of U.S. Ser. Nos. 11/472,587, filed Jun. 21, 2006 and 11/472,586 filed Jun. 21, 2006 are hereby expressly incorporated by reference herein for all purposes.

A first antenna in accordance with the invention has an antenna element structure with four axially coextensive helical tracks 10A, 10B, 10C, 10D plated or otherwise metallised on the cylindrical outer surface of a cylindrical ceramic core 12.

The core has an axial passage in the form of a bore 12B extending through the core 12 from a distal end face 12D to a proximal end face 12P. Both of these faces are planar faces perpendicular to the central axis of the core. They are oppositely directed, in that one is directed distally and the other proximally in this embodiment. Housed within the bore 12B is a coaxial transmission line having a conductive tubular outer shield 16, a first tubular air gap or insulating layer 17, and an elongate inner conductor 18 which is insulated from the shield by the air gap 17. The shield 16 has outwardly projecting and integrally formed spring tangs 16T or spacers which space the shield from the walls of the bore 12B. A second tubular air gap exists between the shield 16 and the wall of the bore.

At the lower, proximal end of the feeder, the inner conductor 18 is centrally located within the shield 16 by an insulative bush 18B.

The combination of the shield 16, inner conductor 18 and insulative layer 17 constitutes a feeder of predetermined characteristic impedance, here 50 ohms, passing through the antenna core 12 for coupling distal ends of the antenna elements 10A to 10D to radio frequency (RF) circuitry of equipment to which the antenna is to be connected. The couplings between the antenna elements 10A to 10D and the feeder are made via conductive connection portions associated with the helical tracks 10A to 10D, these connection portions being formed as radial tracks 10AR, 10BR, 10CR, 10DR plated on the distal end face 12D of the core 12. Each connection portion extends from a distal end of the respective helical track to a location adjacent the end of the bore 12B. The inner conductor 18 has a proximal portion 18P which projects as a pin from the proximal face 12P of the core 12 for connection to the equipment circuitry. Similarly, integral lugs 16F on the proximal end of the shield 16 project beyond the core proximal face 12P for making a connection with the equipment circuitry ground.

The proximal ends of the antenna elements 10A to 10D are connected to a common virtual ground conductor 20 in the form of a plated sleeve surrounding a proximal end portion of the core 12. This sleeve 20 is, in turn, connected to the shield 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. Where antenna elements 10A and 10C are connected to the sleeve 20, the rim 20U is a little further from proximal face 12P than where the antenna elements 10B and 10D are connected to the sleeve 20.

The proximal end face 12P of the core is plated, the conductor 22 so formed being connected at that proximal end face 12P to an exposed portion 16E of the shield conductor 16 as described below. The conductive sleeve 20, the plating 22 and the outer shield 16 of the feed structure together form a quarter wave balun which provides common-mode isolation of the antenna element structure from the equipment to which the antenna is connected when installed. The metallised conductor elements formed by the antenna elements and other metallised layers on the core define an interior volume which is occupied by the core.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and on the other hand, the elements 10A, 10B connected to the shield 16, the sleeve 20 and plating 22 acting as a trap preventing the flow of currents from the antenna elements 10A to 10D to the shield 16 at the proximal end face 12P of the core. It will be noted that the helical tracks 10A-10D are interconnected in pairs by part-annular tracks 10AB and 10CD between the inner ends of the respective radial tracks 10AR, 10BR and 10CR, 10DR so that each pair of helical tracks has one long track 10B, 10D and one short track 10A, 10C. Operation of quadrifilar dielectrically loaded antennas having a balun sleeve is described in more detail in British Patent Applications Nos. 2292638A and 2310543A, the entire disclosures of which are incorporated in this application to form part of the subject matter of this application as filed.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to the antenna element connection portions 10AR, 10BR, together with the dimensions of the bore 12B and the dielectric constant of the material filling the space between the shield 16 and the wall of the bore, are such that the electrical length of the shield 16 on its outer surface is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

There is an air gap surrounding the shield 16 of the feed structure. This air sleeve of lower dielectric constant than the dielectric constant of the core 12 diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely of the cylindrical core axis, the effect of the low dielectric constant sleeve on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing, and sintering.

The antenna is especially suitable for L-band GPS reception at 1575 MHz. In this case, the core 12 has a diameter of about 10 mm and the longitudinally extending antenna elements 10A-10D have an average longitudinal extent (i.e. parallel to the central axis) of about 12 mm. At 1575 MHz, the length of the conductive sleeve 20 is typically in the region of 5 mm. Precise dimensions of the antenna elements 10A to 10D can be determined in the design stage on a trial and error basis by undertaking eigenvalue delay measurements until the required phase difference is obtained. The diameter of the feed structure in the bore 12B is in the region of 2 mm.

Further details of the feed structure will now be described. The feed structure comprises the combination of a coaxial 50 ohm line 16, 17, 18 and a planar laminate board 30 connected to a distal end of the line. The laminate board or printed circuit board (PCB) 30 lies flat against the distal end face of the core 12, in face-to-face contact. The largest dimension of the PCB 30 is smaller than the diameter of the core 12 so that the PCB 30 is fully within the periphery of the distal end face 12D of the core 12.

In this embodiment, the PCB 30 is in the form of a disc centrally located on the distal face 12D of the core. Its diameter is such that it overlies the inner ends of the radial tracks 10AR, 10BR, 10CR and 10DR and their respective part-annular interconnections 10AB, 10CD. The PCB has a substantially central hole 32 which receives the inner conductor 18 of the coaxial feeder structure. Three off-centre holes 34 receive distal lugs 16G of the shield 16. Lugs 16G are bent or "jogged" to assist in locating the PCB 30 with respect to the coaxial feeder structure. All four holes 32 are plated through.

In addition, portions 30P of the periphery of the PCB 30 are plated, the plating extending onto the proximal and distal faces of the board.

Figure 6:
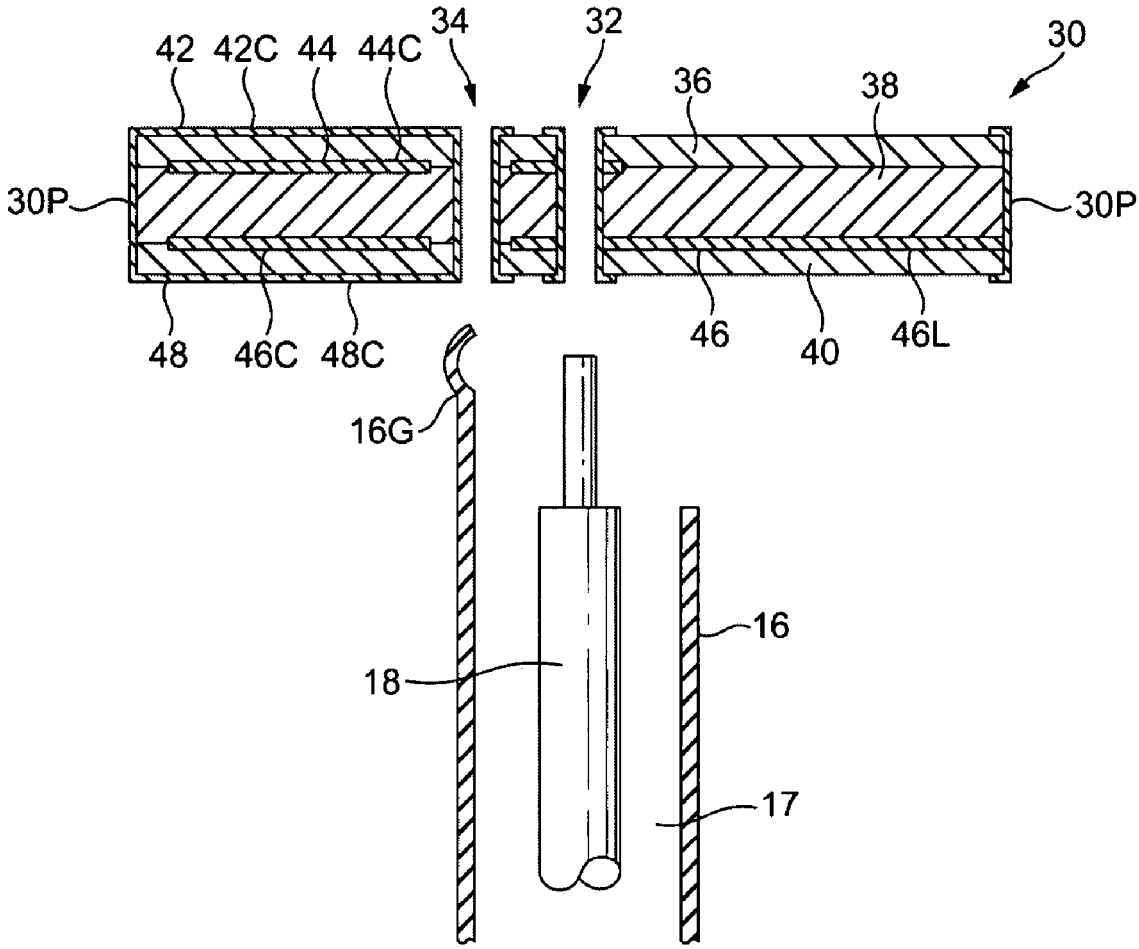
FIG. 6 is a detail of FIG. 5, showing the multiple-layer structure of the laminate board.
Figure 7A:
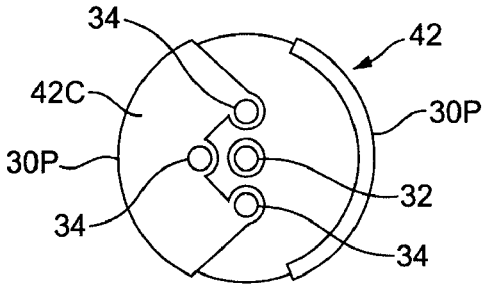
FIGS. 7A to 7D are diagrams showing conductor patterns of the different conductor layers of the laminate board shown in FIG. 6.
Figure 7B:
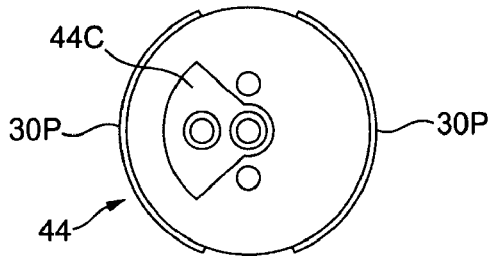
Figure 7C:
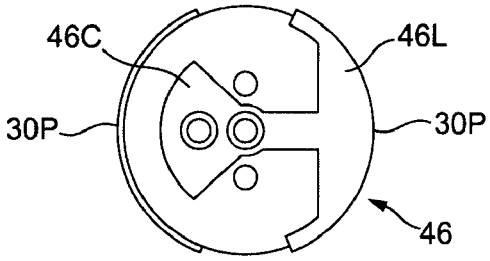
Figure 7D:
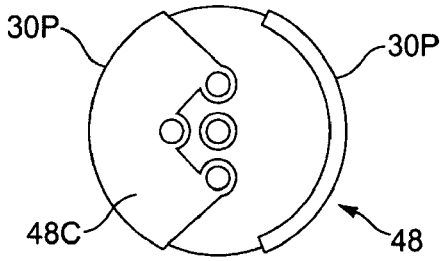

The PCB 30 is a multiple layer laminate board in that it has a plurality of insulative layers and a plurality of conductive layers. In this embodiment, the board has three insulative layers comprising a distal layer 36, an intermediate layer 38, and a proximal layer 40. There are four conductor layers as follows: a distal layer 42, a first intermediate layer 44, a second intermediate layer 46 and a proximal layer 48. The first intermediate conductor layer 44 is sandwiched between the distal and intermediate insulative layers 36, 38, as shown in FIG. 6. The second intermediate conductor layer 46 is sandwiched between the intermediate and proximal insulative layers 38, 40 also shown in FIG. 6. Each conductor layer is etched with a respective conductor pattern, as shown in FIGS. 7A to 7D. Where the conductor pattern extends to the peripheral portions 30P of the PCB 30 and to the plated-through-holes 32, 34 (hereinafter referred to as "vias"), the respective conductors in the different layers are interconnected by the edge plating and the via plating respectively. As will be seen from the drawings showing the conductor patterns of the conductor layers 42, 44, 46 and 48, the first intermediate layer 44 has a first conductor area 44C in the shape of a fan or sector extending radially from a connection to the inner conductor 18 (when seated in via 32) in the direction of the radial antenna element connection portions 10AR, 10BR. Directly above this conductive area 44C, the distal conductor layer 42 has a generally sector-shaped area 42C extending from a connection with the shield 16 of the feeder (when received in plated via 34) to the board periphery 30P. In this way, a shunt capacitor is formed between the inner feeder conductor 18 and the feeder shield 16, the material of the distal insulative layer 36 acting as the capacitor dielectric. This material typically has a relative dielectric constant greater than 5.

It will also be seen from the drawings showing the conductive patterns of the conductive layers 42, 44, 46 and 48, that the second intermediate layer 46 has a first conductive area 46C in the shape of a fan or sector extending radially from a connection to the inner conductor 18 (when seated in via 32) in the direction of the radial antenna element connection portions 10AR, 10BR. Directly beneath this conductive area 46C, the proximal conductor layer 48 has a generally fan or sector shaped area 48C extending from a connection with the shield 16 of the feeder (when received in plated via 34) to the board periphery 30P overlying the part-annular track 10AB interconnecting the radial connection elements 10AR, 10BR. In this way, a further shunt capacitor is formed between the inner feed conductor 18 and the feeder shield 16, the material of the proximal insulative layer 40 acting as the capacitor dielectric. This material also typically has a relative dielectric constant greater than 5. The intermediate insulative layer 38 separates the intermediate conductor layers 44 and 46 and acts as a rigid support layer. Typically it has a lower relative dielectric constant than the distal and proximal insulative layers.

The conductor pattern of the intermediate conductive layer 46 is such that it has a second conductor area 46L extending from the connection with the inner feeder conductor 18 to the second plated outer periphery 30P so as to overlie the part-annular track 10CD and the inner ends of the radial connection elements 10CR and 10DR. There is no corresponding underlying conductive area in the conductor layer 48. The conductive area 42L between the central hole 32 and the plated peripheral portion 30P overlying the radial connection tracks 10CR and 10DR acts as a series inductance between the inner conductor 18 of the feeder and one of the pairs of helical antenna elements 10C, 10D.

Figure 8:
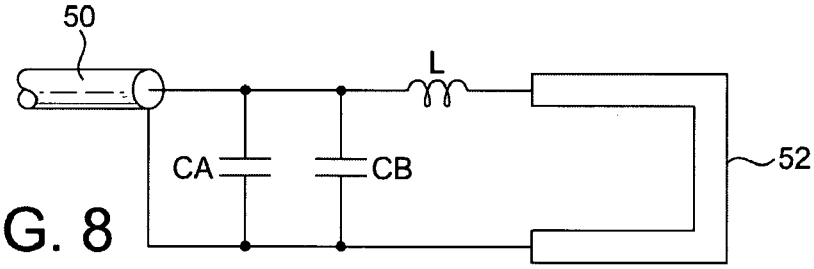
FIG. 8 is an equivalent circuit diagram.

When the combination of the PCB 30 and the elongate feeder 16-18 is mounted to the core 12 with the proximal face of the PCB 30 in contact with the distal face 12D of the core, aligned over the interconnection elements 10AB and 10CD as described above, connections are made between the peripheral portions 30P and the underlying tracks on the core distal face to form a matching circuit as shown schematically in FIG. 8.

In the schematic of FIG. 8, the feeder is indicated as a coaxial line 50, the antenna elements as a conductive loop 52 and the shunt capacitors and series inductor as capacitors CA and CB and inductor L respectively.

The proximal and distal insulative layers of the PCB 30 are formed of a ceramic-loaded plastics material to yield a relative dielectric constant for the layers 36 and 40 in the region of 10. The intermediate insulative layer 38 can be made of the same material or one having a lower dielectric constant, e.g. FR-4 epoxy board, which has a dielectric constant in the region of 4.5. The thickness of the proximal and distal layers 36 and 40 is much less than that of the intermediate layer 38. Indeed, the intermediate layer 38 acts as a support for the proximal and distal layers 36 and 40. The proximal and distal insulative layers of the PCB 30 have a thickness of between 60 μm and 100 μm. The intermediate insulative layer 38 has a thickness in the region of 600 μm.

Connections between the feeder 16-18, the PCB 30 and the conductive tracks on the proximal face 12P of the core are made by soldering or by bonding with conductive glue. The feeder 16-18 and the PCB 30 together form a unitary feeder structure when the distal end of the inner conductor 18 is soldered in the via 32 of the PCB 30, and the shield lugs 16G in the respective off-centre vias 34. The feeder 16-18 and the PCB 30 together form a unitary feed structure with an integral matching network.

The shunt capacitances CA and CB and the series inductance L form a matching network between the coaxial line 50 (at the distal end of the feeder 16-18) and the radiating antenna element structure of the antenna. The shunt capacitances and the series inductance together match the impedance presented by the coaxial line, physically embodied as shield 16, air gap 17 and inner conductor 18, when connected at its distal end to radiofrequency circuitry having a 50 ohm termination end (i.e. the distal end of the line formed by shield 16, air gap 17 and inner conductor 18), this coaxial line impedance being matched to the impedance of the antenna element structure at its operating frequency or frequencies.

As stated above, the feed structure is assembled as a unit before being inserted in the antenna core 12, the laminate board 30 being fastened to the coaxial line 16-18. Forming the feed structure as a single component, including the board 30 as an integral part, substantially reduces the assembly cost of the antenna, in that introduction of the feed structure can be performed in two movements: (i) sliding the unitary feed structure into the bore 12B and (ii) fitting a conductive ferrule or washer 21 around the exposed proximal end portion of the shield 16. The ferrule may be a push fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the bore 12B. Therefore, after completion of steps (i) and (ii) above, the assembly can be passed through a solder reflow oven or can be subjected to alternative soldering processes such as laser soldering, inductive soldering or hot air soldering as a single soldering step.

The washer 21 referred to above for fitment to the exposed proximal end portion of the shield 16 may take various forms, depending on the structure to which the antenna is to be connected. In particular, the shape and dimensions of the washer will vary to mate with the ground conductors of the equipment to be connected to the antenna, whether such conductors comprise part of a standard coaxial connector kit, a printed circuit board layer, or conductive plane, etc.

The tangs 16T on the feeder shield also help to centralise the feeder and the laminate board 30 with respect to the core 12 during assembly. Solder bridges formed between (a) conductors on the peripheral and the proximal surfaces of the board 30 and (b) the metallised conductors on the distal face 12D of the core, and the shapes of the conductors themselves, are configured to provide balancing rotational meniscus forces during reflow soldering when the board is correctly orientated on the core.

Figure 9:
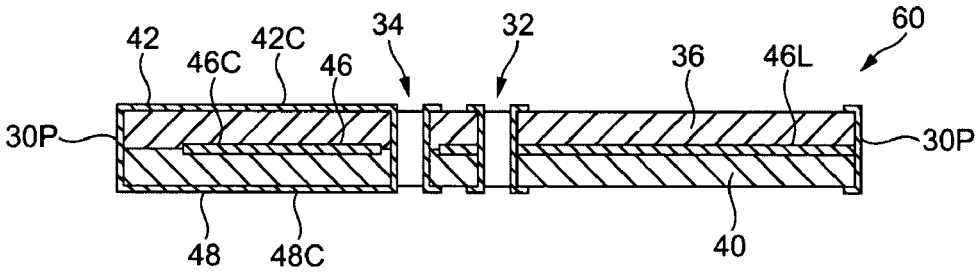
FIG. 9 is a cross-section of an alternative multi-layer laminate board.

Referring now to FIG. 9, a laminate board 60 forming part of an alternative antenna in accordance with the invention is shown. Features common to the laminate board 30, shown in FIG. 6, are identified with like reference numerals.

The PCB 60 is a multiple layer laminate board in that it has a plurality of insulative layers and a plurality of conductive layers. In this embodiment, the board has two insulative layers comprising a distal layer 36 and a proximal layer 40. The board does not have an intermediate insulative layer. There are three conductor layers as follows: a distal layer 42, an intermediate layer 46, and a proximal layer 48. The intermediate conductor layer 46 is sandwiched between the distal and proximal insulative layers 36, 40, as shown in FIG. 9. Each conductor layer is etched with a conductor pattern. Distal layer 42 takes the conductive pattern shown in FIG. 7A, intermediate layer 46 takes the conductor pattern shown in FIG. 7C, and proximal layer 48 takes the conductor pattern shown in FIG. 7D.

As with the laminate board 30, conductive areas 46C and 48C form a first shunt capacitor between the inner feeder conductor 18 and the feeder shield 16, the material of the insulative layer 40 acting as the capacitor dielectric. Additionally, conductive areas 46C and 42C form a further shunt capacitor between the inner feed conductor 18 and the feeder shield 16, the material of the distal insulative layer 36 acting as the capacitive dielectric.

The proximal insulative layer of the PCB 60 is formed of a ceramic-loaded plastics material to yield a relative dielectric constant for the layer 40 in the region of 10. The distal insulative layer 36 can be made of the same material. The thickness of the proximal layer 40 is substantially the same as that of the distal layer 36. The thickness of the insulative layers is typically in the region of 60 μm to 100 μm. In view of this, the insulative layers may have little structural rigidity and therefore a thicker, support layer of insulative material (not shown) may be provided on the distal surface of the distal layer of insulative material. This insulative support layer would typically have a thickness of 600 μm, would substantially cover the laminate board and would have a relative dielectric constant in the region of 4.5.

Figure 4:
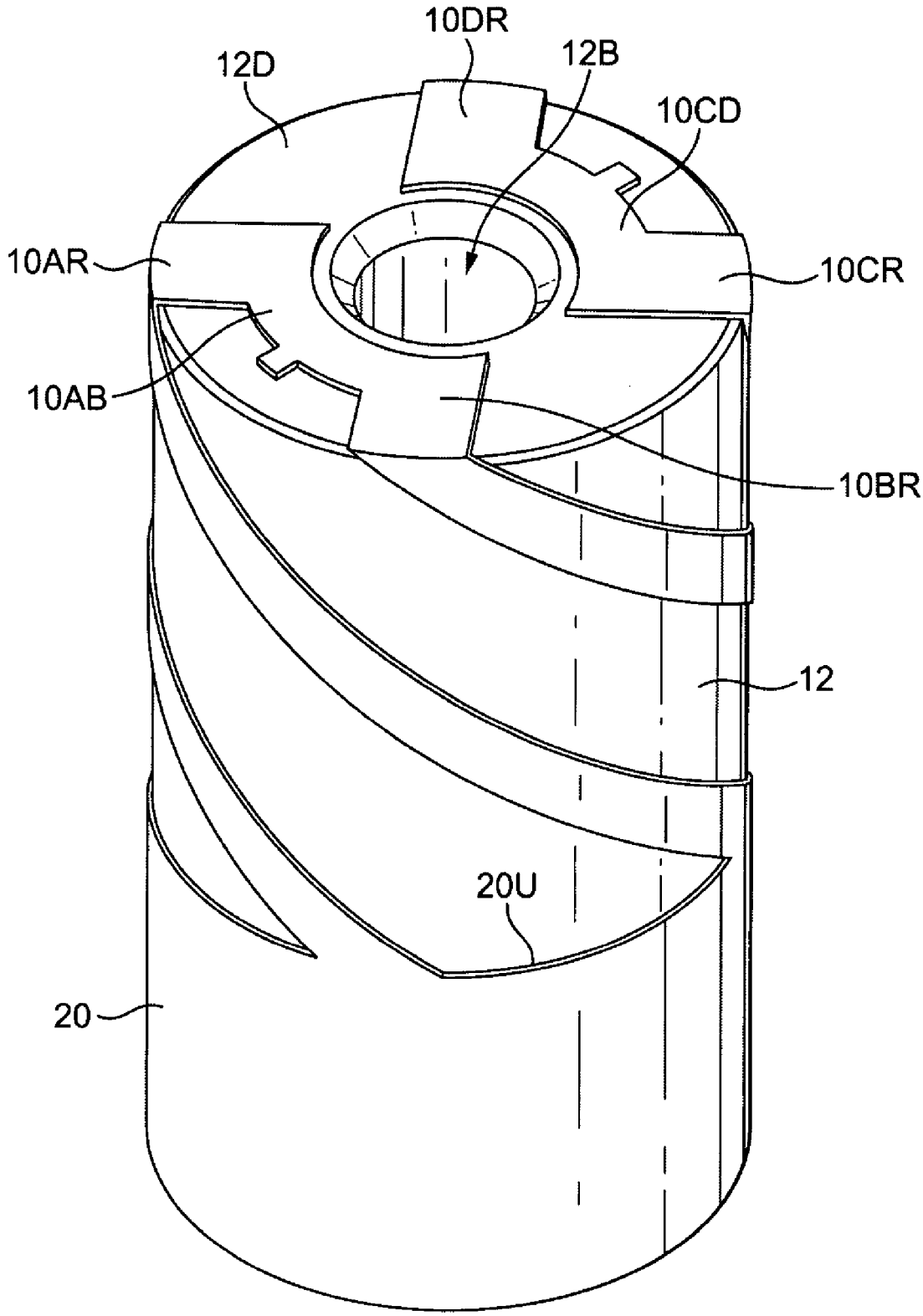
FIG. 4 is a perspective view of the plated antenna core, showing conductors on an upper (distal) surface.
Figure 5:
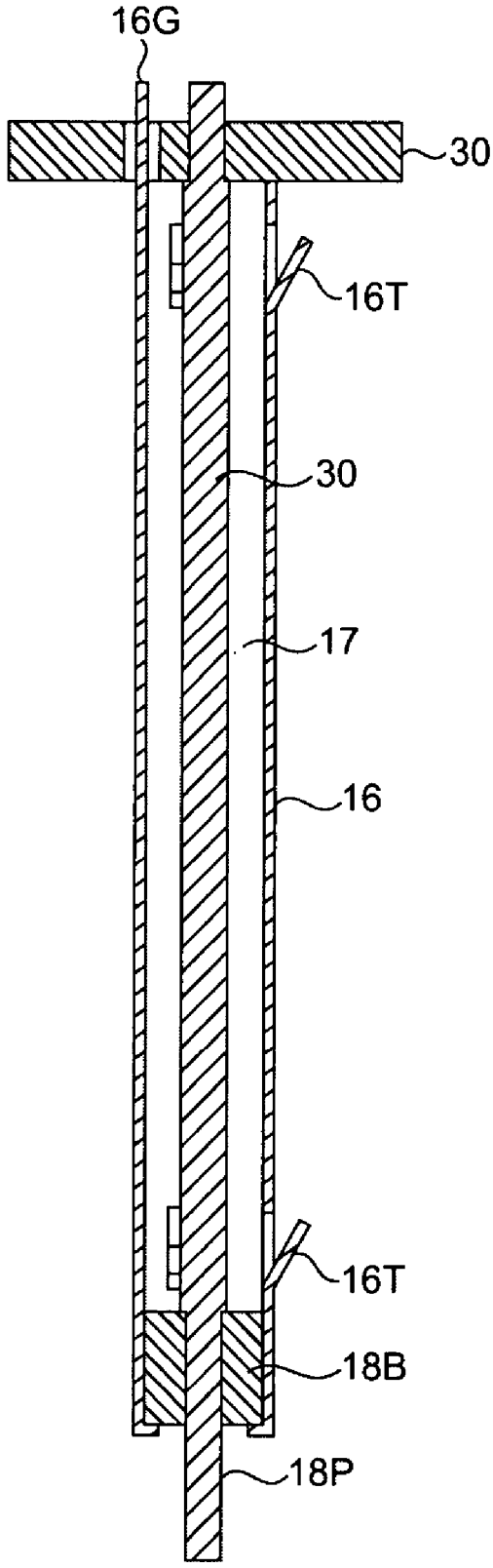
FIG. 5 is a cross-section of a feeder structure comprising a coaxial feeder and a laminate board perpendicular to the axis of the feeder and embodying a matching network.

In a further alternative embodiment (not shown), the shield 16 of the coaxial line has no connecting lugs but, instead, has a flared or swaged distal end which abuts a conductor layer portion on the underside of the board 30, 60. The conductive layer has a solder coating which provide a solder connection with the swaged end when heated. The swaged end is seated on the chamfered periphery (see FIG. 4) of the distal end of the bore 12B, thereby axially locating the coaxial line 16 to 18 in the core 12.

The invention claimed is:

1. A dielectrically loaded antenna for operation at a frequency in excess of 200 MHz comprising: an electrically insulative core of a solid material having a relative dielectric constant greater than 5 and having transversely extending end surfaces and a side surface which extends longitudinally between the end surfaces; a three-dimensional antenna element structure including at least a pair of elongate conductive antenna elements disposed on or adjacent the side surface of the core and extending from one of the end surfaces towards the other end surface; a feed connection comprising first and second feed connection conductors coupled respectively to one and the other of the elements of the said pair; and a matching section comprising a laminate board having at least two insulative layers and at least three conductive layers, arranged alternately to provide at least one shunt capacitance, wherein each conductive layer comprises a first portion, each first portion being a conductor of the shunt capacitance, formed by said layers and coupled across the antenna elements of the pair.

2. The antenna according to claim 1, wherein a first and a second of the conductive layers are formed on opposing outer surfaces of the laminate board and a third of the conductive layers is formed between two of the insulative layers.

3. The antenna according to any preceding claim, wherein the core is cylindrical and the antenna elements of the said pair comprise conductive helical tracks each extending from the said one end surface over the cylindrical side surface, and the antenna element structure includes a linking conductor encircling the core and interconnecting ends of the said antenna elements which are at locations spaced from the said one end surface of the core.

4. The antenna according to claim 3, wherein the laminate board is a disc.

5. The antenna according to claim 4, wherein the first portions are substantially sector shaped.

6. The antenna according to claim 5, wherein each of said first portions are aligned in the axial direction.

7. The antenna according to claim 6, wherein the said first portions of the first and second conductive layers are electrically connected by plating formed on the cylindrical surface of the laminate board.

8. The antenna according to claim 1, wherein the laminate board is secured to a distal end surface of the antenna core.

9. The antenna according to claim 8, wherein the first portions of the first and second conductive layers are coupled to one of the elements of each said pair of antenna elements and the first portion of the third conductive layer is coupled to the other of the elements of said pair.

10. The antenna according to claim 1, wherein the matching section further comprises a series inductance coupled between the shunt capacitance and one of the antenna elements of the or each said pair.

11. The antenna according to claim 10, wherein the third layer further comprises a second portion coupled to the said first portion and further coupled to one of the elements of the or each said pair of antenna elements, the second portion forming the series inductance.

12. An antenna according to claim 1, wherein the laminate board further comprises an intermediate insulative layer, and a fourth conductive layer, wherein the third conductive layer positioned between the proximal and an intermediate insulative layers, and the fourth conductive layer is positioned between the intermediate insulative layer and the distal insulative layer.

13. The antenna according to claim 12, wherein the proximal and distal insulative layers each have a thickness of from 60 μm to 100 μm.

14. The antenna according to claims 12 or 13, wherein the intermediate insulative layer has a thickness of from 400 μm to 1000 μm.

15. The antenna according to claims 13 or 14, wherein the transmission line section is secured to and extends perpendicularly from the laminate board.

16. The antenna according to claim 12 or 13, wherein the ratio of the thickness of each of the proximal and distal insulative layers to the thickness of the intermediate insulative layer is between 1/16 to 1/4.

17. The antenna according to claim 12 or 13, wherein at least one of said insulative layers includes a ceramic material.

18. The antenna according to claim 12 or 13, wherein the relative dielectric constant of the proximal and distal insulative layers is greater than 5.

19. The antenna according to claim 18, wherein the relative dielectric constant of the intermediate insulative layer is greater than 10.

20. The antenna according to claim 12 or 13, comprising a feeder structure including the said feed connection, the said matching section, and an axial transmission line section which terminates in the said feed connection.

21. The antenna according to claim 13, wherein the transmission line section is housed in a passage passing through the care from one end surface to the other end surface.

* * * * *

UNITED STATES PATENT AND TRADEMARK OFFICE

CERTIFICATE OF CORRECTION

PATENT NO. : 7,633,459 B2
APPLICATION NO. : 11/899413
DATED : December 15, 2009
INVENTOR(S) : Andrew Robert Christie et al.

It is certified that error appears in the above-identified patent and that said Letters Patent is hereby corrected as shown below:

In column 14, line 15 (claim 21) replace "care" with -- core --.

Signed and Sealed this

Ninth Day of February, 2010

David J. Kappos

David J. Kappos
*Director of the United States Patent and Trademark Office*